US005165252A

United States Patent [19]

Hannibalsen

[11] Patent Number: 5,165,252

[45] Date of Patent: Nov. 24, 1992

[54] FREEZER WITH MEANS PREVENTING THE FORMATION OF FROST

[75] Inventor: Folmer O. Hannibalsen, Hörsholm, Denmark

[73] Assignee: Aktiebolaget Electrolux, Stockholm, Sweden

[21] Appl. No.: 807,275

[22] Filed: Dec. 13, 1991

[30] Foreign Application Priority Data

Jan. 10, 1991 [SE] Sweden ..... 9100080

[51] Int. Cl.[5] ..... F25D 17/04

[52] U.S. Cl. ..... 62/273; 277/3

[58] Field of Search ..... 62/273, 272, 385, 410, 62/150; 277/3, 70, 34

[56] References Cited

U.S. PATENT DOCUMENTS 2,741,897 4/1956 Riggins ..... 62/273

2,986,014 5/1961 Schilling ..... 62/272

3,813,896 6/1974 Lebahn ..... 62/273 X 3,826,106 7/1974 O'Hanlon et al. ..... 62/275

4,432,556 2/1984 Green et al. ..... 277/3 X

*Primary Examiner*—Albert J. Makay

*Assistant Examiner*—William C. Doerrler

*Attorney, Agent, or Firm*—Pearne, Gordon, McCoy & Granger

[57] ABSTRACT

The storing space of a freezer (10) communicates with a flexible bag (30) arranged on the outside of the freezer. The bag takes up the volume changes which the air in the space goes through as a consequence of normal temperature oscillation of cooling surfaces (14) in the space. By this, the humidity of ambient air is prevented from being sucked into the space past the lid or door sealing (20) of the freezer and form frost on the cooling surfaces (14).

4 Claims, 1 Drawing Sheet

FREEZER WITH MEANS PREVENTING THE FORMATION OF FROST

The invention refers to a freezer with an openable space for storing goods, which space shows cold surfaces for keeping the goods at freezing temperature.

Such a freezer can be constituted by a conventional chest freezer operated by a compressor working for about 15 minutes and cooling down the cold surfaces in the space to about −25° C., after which the compressor stops and does not start again until after about 15 minutes, when the temperature of the cold surfaces has risen to about −16° C. Goods which are stored in the space can in this way be kept at a temperature of about −18° C.

When the compressor works, the temperature goes down and thereby the pressure of the air which is in the space, resulting in that ambient air will be sucked into the space past the sealing which normally is arranged around the edge of a lid of the chest. This air contains humidity which will form frost on the cold surfaces and remains on these when the compressor then stops the temperature, and thereby the pressure of the air in the space, rises and the excess air is pressed out to the surroundings past the sealing.

At freezers, which are not opened so often, perhaps once a day, 90% of the frost can have been formed by humidity which in the way described above has forced its way into the space, while the remaining 10% originate among other things from humidity which has come into the space when the door has been opened.

The object of the invention is to bring about a freezer of the kind set forth above where the formation of frost, as a consequence of humidity forcing its way into the space when it is closed, is substantially eliminated.

This object is obtained through the freezer according to the invention thereby that the space communicates with the interior of a container having a flexible air impermeable wall, the outside of which being subjected to substantially the pressure prevailing outside the freezer.

By this, the time of use of the freezer is substantially extended before it has to be defrosted.

Figure 1:
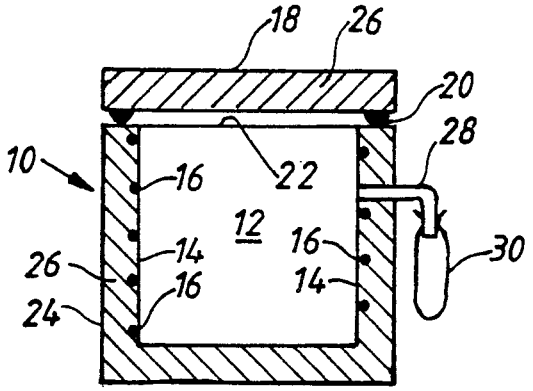
Figure 2:
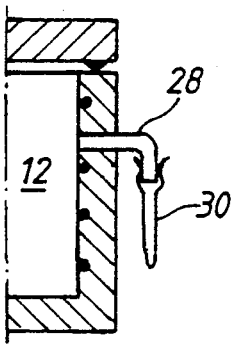
Figure 3:
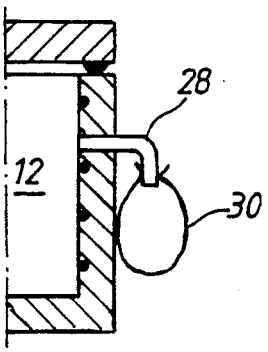
Figure 4:
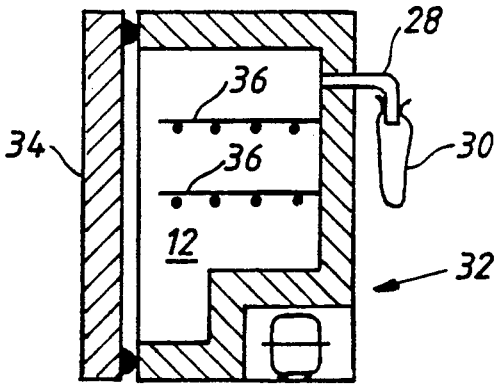

An embodiment of a freezer according to the invention is described below in connection with the enclosed drawing, in which FIG. 1 shows a sectional view of a chest freezer with a bag arranged on the outside of the box, FIG. 2 shows a part of the sectional view in FIG. 1 with the bag in a contracted state, FIG. 3 shows a part of the sectional view in FIG. 1 with the bag in an expanded state and FIG. 4 shows the bag arranged at a freezer cabinet.

By 10 is designated a chest freezer with a space 12 for storing goods at freezing temperature. The goods are refrigerated by cold surfaces 14 which are in heat conductive contact with pipes 16 constituting an evaporator of a refrigerating apparatus operated by a compressor (not shown). The space 12 is closable by a lid 18 provided with a sealing 20 which seals against a horizontal surface 22 surrounding an access opening to the space 12. The lower part 24 and the lid 18 of the chest are provided with a heat insulation 26.

A pipe 28 extends from the space 12 through the insulation 24 to the outside of the chest, where an air and humidity impermeable bag 30 is arranged on the pipe 28.

The refrigerating apparatus is of a conventional kind where the compressor works intermittently, the compressor e.g: working for 15 minutes and after that standing for 15 minutes. When the compressor works the surfaces 14 are cooled down, the air in the space 12 contracting and sucking in air from the bag 30 (FIG. 2). When the compressor stands the temperature of the surfaces 14 rises, the air in the space 12 expanding and blowing up the bag 30 (FIG. 3).

The volume of the bag must be at least so large that it can take up the whole air volume which during normal operation with the lid 18 closed leaves the space 12 when the compressor stands, and thus the temperature in the space rises.

FIG. 4 shows the invention applied to a freezer cabinet 32 having a vertical door 34. The cold surfaces are here constituted by shelves 36 in the cabinet.

I claim:

1. A freezer (10,32) with an openable space (12) for storing goods, which space is exposed to cold surfaces (14,36) for keeping the goods at a freezing temperature, said space (12) communicating with the interior of a container (30) located externally of said space, said container having a flexible air impermeable wall, the outside of which being subjected to substantially the pressure prevailing outside the freezer.

2. The freezer according to claim 1, wherein the container consists of a bag (30) located on the outside of the freezer.

3. The freezer according to claim 1 or 2, wherein it consists of a chest freezer (10) with a horizontal lid (18).

4. The freezer according to claim 1 or 2, wherein it consists of a freezer cabinet (32) with a vertical door (34).

* * * * *